US006199893B1

(12) United States Patent
Fumagalli

(10) Patent No.: US 6,199,893 B1
(45) Date of Patent: Mar. 13, 2001

(54) SNOWBOARD BINDING WITH ADJUSTABLE-RIGIDITY BASE

(75) Inventor: Martino Fumagalli, Seregno (IT)

(73) Assignee: Calzaturificio Piva S.r.l., Pederobba (IT)

( * ) Notice: Subject to any disclaimer, the term of this patent is extended or adjusted under 35 U.S.C. 154(b) by 0 days.

(21) Appl. No.: 09/437,323

(22) Filed: Nov. 10, 1999

(30) Foreign Application Priority Data

Nov. 12, 1998 (IT) ..... PD98A0263

(51) Int. Cl.[7] ..... A63C 5/07

(52) U.S. Cl. ..... 280/602; 280/14.21; 280/607; 280/618

(58) Field of Search ..... 280/602, 607, 280/14.2, 613, 616, 617, 618, 619, 626

(56) References Cited

U.S. PATENT DOCUMENTS 5,251,923 * 10/1993 Stepanek et al. ..... 280/602
5,261,689 * 11/1993 Carpenter et al. ..... 280/618
5,269,555 * 12/1993 Ruffinengo ..... 280/602
5,326,126 * 7/1994 Ruffinengo ..... 280/602
5,553,883 * 9/1996 Erb ..... 280/607
5,577,755 * 11/1996 Metzger et al. ..... 280/607
5,820,155 * 10/1998 Brisco ..... 280/613

FOREIGN PATENT DOCUMENTS

4106401 * 9/1992 (DE) .
2626189 * 7/1989 (FR) .
405220245 * 8/1993 (JP) .

* cited by examiner

*Primary Examiner*—Brian L. Johnson
*Assistant Examiner*—Bryan Fischmann
(74) *Attorney, Agent, or Firm*—Guido Modiano; Albert Josif; Daniel O'Byrne

(57) ABSTRACT

A snowboard binding comprising a flat base which is provided with elements for fixing to a shoe and is centrally provided with a circular opening which is shaped complementarily to a plate for fixing to the snowboard so that the base can be rotated adjustably about the plate. The base has, around the opening, notches for engaging the plate in preset angular positions, the base further comprising, adjacent to at least one of its lateral edges, two arms which protrude from the base and converge in a region where the arms are mutually opposite and rigidly coupled to elements for adjusting the mutual distance between the arms.

5 Claims, 1 Drawing Sheet

SNOWBOARD BINDING WITH ADJUSTABLE-RIGIDITY BASE

BACKGROUND OF THE INVENTION

The present invention relates to a snowboard binding with adjustable-rigidity base.

It is known that one kind of snowboard binding that is particularly suitable for soft boots comprises a flat base provided with straps for fixing to the boot and with a heel unit for the rear resting thereof.

The base is centrally provided with a circular opening which is complementary with respect to a plate for fixing to the snowboard so that it can adjustably rotate about the plate.

Accordingly, by loosening the fixing of the plate to the snowboard it is possible to vary the inclination of the base with respect to the axis of the snowboard and therefore vary the arrangement of the foot.

The base has, around the opening, a plurality of notches which constitute means for engaging teeth of the plate in suitable angular positions so that mutual fixing after adjustment is stable.

The degree of inclination of the binding with respect to the axis of the snowboard is a parameter which depends on the choices made by the athlete and in particular on the posture that he intends to achieve in order to perform athletic body and leg movements in the best manner and achieve the best results.

In this context, the interaction between the binding and the snowboard also becomes particularly important, since the binding is the means by which the movements are transmitted to the board.

In particular, the rigidity of the base, which is currently substantially uniform, affects the entire region of the board to which the base is fixed.

SUMMARY OF THE INVENTION

The aim of the present invention is to provide a snowboard binding whose flat base can adjust its rigidity so that it is possible to adjust its sensitivity, and the sensitivity of the snowboard, to the movements applied by the athlete.

Within the scope of the above aim, an object of the invention is to provide a snowboard binding with a base whose rigidity can be adjusted on either side with respect to the shoe locked by the binding.

A further important object of the invention is to provide a snowboard binding which does not entail particular complications with respect to current ones.

A still further object of the present invention is to provide a snowboard binding whose dimensions are substantially the same as those of current bindings.

A further object of the invention is to provide a snowboard binding which can be produced with conventional machines and equipment at a cost which is substantially comparable with that of current bindings.

This aim, these objects and others which will become apparent hereinafter are achieved by a snowboard binding comprising a flat base which is provided with means for fixing to a shoe and is centrally provided with a circular opening which is shaped complementarily to a plate for fixing to a snowboard so that it can be rotated adjustably about said plate, said base having, around said opening, means for engaging said plate in preset angular positions, wherein said base has, adjacent to at least one of lateral edges thereof, two arms which protrude from said base and converge in a region where said arms are mutually opposite and rigidly coupled to means for adjusting the mutual distance between said arms.

BRIEF DESCRIPTION OF THE DRAWINGS

Further characteristics and advantages of the present invention will become apparent from the detailed description of an embodiment thereof, illustrated only by way of non-limitative example in the accompanying drawings, wherein.

DESCRIPTION OF THE PREFERRED EMBODIMENTS

Figure 1:
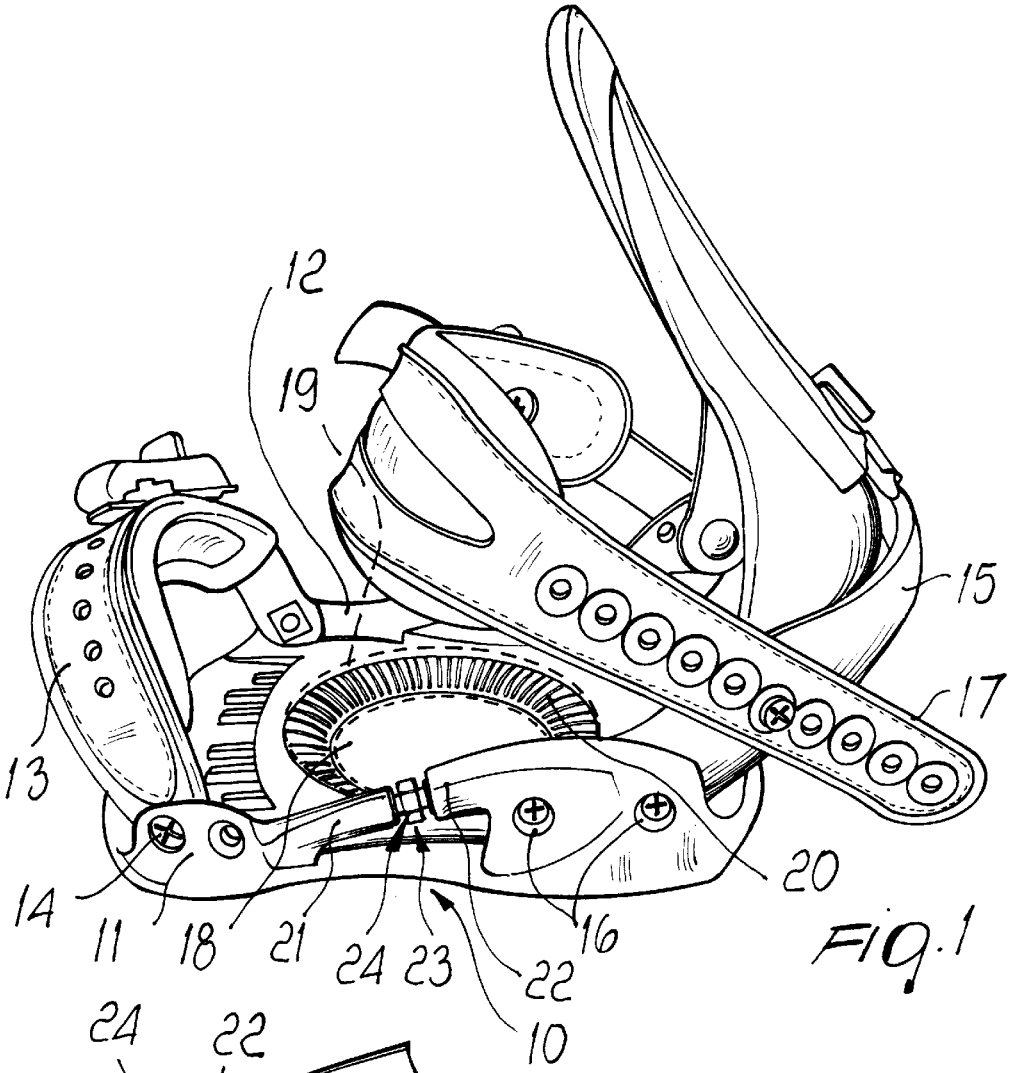
FIG. 1 is a perspective view of a snowboard binding according to the present invention.
Figure 2:
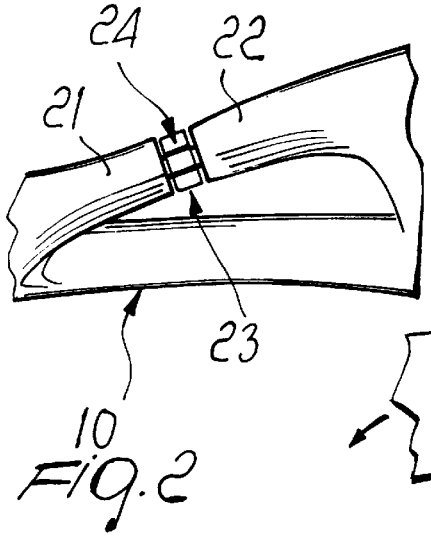
FIG. 2 is an enlarged-scale view of the binding of FIG. 1.
Figure 3:
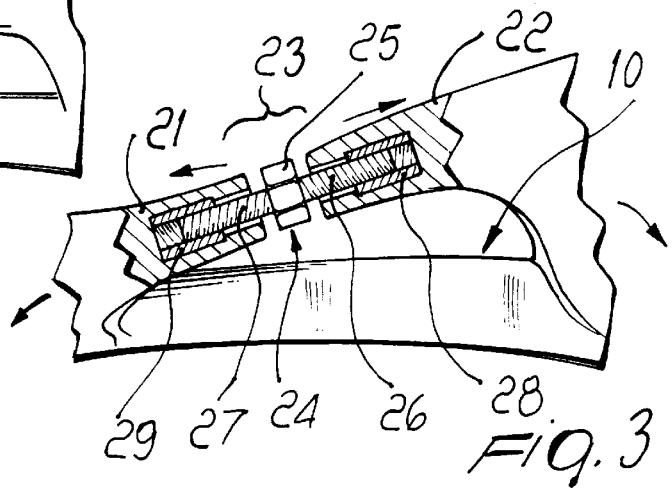
FIG. 3 is a sectional view of the detail of FIG. 2.

With reference to the above figures, a snowboard binding comprises a flat base 10 which can be conveniently made of metal or plastic and is substantially rectangular, with raised lateral edges 11 and 12 along its longer sides; means for fixing to a shoe (which is not shown for the sake of simplicity) are rigidly coupled to the front and to the rear of the base.

The fixing means are constituted, at the front, by an adjustable strap 13 which is fixed at its ends by means of screws 14 to the edges 11 and 12, and at the rear by a heel unit 15 which is also rigidly coupled by means of screws 16 to the edges 11 and 12 and is provided with an adjustable strap 17.

The base 10 is provided, at its center, with a circular opening 18 which is complementarily shaped with respect to a plate 19 (shown in dashed lines in FIG. 1) for fixing to the snowboard (not shown) in order to be adjustably rotatable about the plate.

The base 10 has, around the opening 18, a plurality of radial notches for engaging teeth, not shown, of the plate 19 in order to provide specific angular mutual arrangement positions to be stably maintained.

According to the invention, the base 10 has two arms defined at least at one of the lateral raised edges 11 and 12; in particular, the arms are defined in the edges, and only the arms designated by the reference numerals 21 and 22, related to the edge 11, are visible in the figures. The arms protrude longitudinally from said base 10 and converge in a region 23, where they are mutually opposite and are rigidly coupled to means for adjusting their mutual distance. In practice, the arms are defined in an upper region of each edge.

The adjustment means are constituted, in this case, by a screw 24 with a hexagonal central head 25 and two mutually opposite threaded shanks 26 and 27 which have respectively right- and left-handed threads and engage corresponding threaded bushings 28 and 29 embedded in the arms 21 and 22.

As shown in the figures, the arms 21 and 22 form, as a whole, a bridge-shaped structure with respect to the base 10 and their ends are coaxial.

When the screw 24 is turned in one direction, by screwing into the bushings 28 and 29, it causes the ends of the arms 21 and 22 to move mutually closer; when the screw is turned in the opposite direction, the ends of the arms 21 and 22 move apart.

This submits to flexural stress the corresponding part of the base 10 which, being fixed to the snowboard and therefore forced to remain motionless, becomes more rigid by acquiring a flexural preloading.

The arc that it would tend to form would be concave toward the snowboard (when the arms 21 and 22 move apart), and this preloading of the base must be overcome before the snowboard can respond to the movements applied by the athlete. Subjected to this flexural preloading the base 10 would ideally tend to rest on the upper surface of the snowboard touching it with its front and rear regions. However, in reality the base 10 always lies flat against the snowboard and the effect of the preloading is just the desired one, i.e. increase the rigidity of the base.

The presence of two arms with adjustable distance at each side of the base 10 of course allows to diversify the response of the base 10 to the stresses applied by the athlete.

It should also be observed that the same adjustment of the distance between the two arms 21 and 22 can also be achieved in other ways, for example by interposing wedge-shaped elements of various sizes to be chosen from a range available to the user, eccentric-element devices, etc.

In practice it has been found that the intended aim and objects of the present invention have been achieved.

The base of the snowboard binding in fact allows the user to adjust its rigidity at will, depending on his specific requirements, skill, etc.

The binding has substantially the same appearance as conventional bindings both in terms of dimensions and substantially in terms of aesthetics.

Moreover, its production does not entail particular complications.

The invention thus conceived is susceptible of numerous modifications and variations, all of which are within the scope of the inventive concept.

All the details may also be replaced with other technically equivalent elements.

In practice, the materials employed, so long as they are compatible with the contingent use, as well as the dimensions, may be any according to requirements.

What is claimed is:

1. A snowboard binding with adjustable rigidity base, comprising a flat base which is provided with means for fixing to a shoe and is centrally provided with a circular opening which is shaped complementarily to a plate for fixing to a snowboard so that said base can be rotated adjustably about said plate, said base having, around said opening, means for engaging said plate in preset angular positions, wherein said base comprises, adjacent to at least one of lateral edges thereof, two arms which protrude from said base and converge in a region where said arms are mutually opposite and rigidly coupled to means for adjusting the mutual distance between said arms.

2. The binding according to claim 1, wherein said arms form, as a whole, a bridge-like structure with respect to said base, the ends of said arms being coaxial and said adjustment means being arranged between said arms.

3. The snowboard binding according to claim 2, wherein said adjustment means comprise a screw with a central head and mutually opposite first and second threaded shanks, one of said shanks having a right-handed thread, another one of said shanks having a left-handed thread, said shanks engaging in said ends of said arms, said ends being perforated.

4. The snowboard binding according to claim 1, wherein said adjustment means are constituted by replaceable wedges arranged between said arms.

5. The snowboard binding according to claim 1, wherein said adjustment means are constituted by eccentric devices arranged between said arms.

* * * * *